US007165596B1

(12) United States Patent
Helton

(10) Patent No.: US 7,165,596 B1
(45) Date of Patent: Jan. 23, 2007

(54) SHADE FOR PREVENTING RAIN FROM ENTERING AN OPEN DOUBLE HUNG WINDOW OF ANY WIDTH

(76) Inventor: Donna Helton, P.O. Box 133, Washburn, TN (US) 37888

( * ) Notice: Subject to any disclaimer, the term of this patent is extended or adjusted under 35 U.S.C. 154(b) by 0 days.

(21) Appl. No.: 10/880,792

(22) Filed: Jun. 30, 2004

(51) Int. Cl.
*E06B 9/00* (2006.01)

(52) U.S. Cl. ..... 160/222; 454/220

(58) Field of Classification Search ..... 160/216, 160/221, 218, 222, 354, 368.1, 227, 226, 160/88, 114; 454/214, 215, 220
See application file for complete search history.

(56) References Cited

U.S. PATENT DOCUMENTS 1,075,058 A * 10/1913 Orth ..... 454/220
1,465,722 A * 8/1923 Thomas ..... 454/220
1,660,793 A * 2/1928 Hodge ..... 454/220
1,719,980 A * 7/1929 Imbruglia ..... 454/220
2,240,406 A * 4/1941 Kurtz ..... 160/88
3,743,346 A 7/1973 Senn et al.
4,079,772 A * 3/1978 Klaenhammer et al. . 160/268.1
4,249,589 A * 2/1981 Loeb ..... 160/368.1
4,899,646 A 2/1990 Maras
5,088,540 A * 2/1992 Harris ..... 454/220
5,228,238 A 7/1993 Fenkell
6,341,811 B1 1/2002 Schoelkopf

* cited by examiner

*Primary Examiner*—David Purol
(74) *Attorney, Agent, or Firm*—Richard L. Miller

(57) ABSTRACT

A shade for preventing rain from entering an open double hung window of any width. A pair of side panels extend rearwardly from opposite ends of a front panel so as to form an assembly for attaching to the double hung window by an apparatus. Each side panel is right triangular-shaped. The front panel is length adjustable by being a pair of telescoping panels. The apparatus includes hook and loop fasteners, a magnetic tape, or a channel affixed to the double hung window receiving a depending lip of the front panel.

18 Claims, 4 Drawing Sheets

SHADE FOR PREVENTING RAIN FROM ENTERING AN OPEN DOUBLE HUNG WINDOW OF ANY WIDTH

BACKGROUND OF THE INVENTION

1. Field of the Invention

The present invention relates to a shade for preventing rain from entering an open window. More particularly, the present invention relates to a shade for preventing rain from entering an open double hung window of any width.

2. Description of the Prior Art

Numerous innovations for shades have been provided in the prior art that will be described. Even though these innovations may be suitable for the specific individual purposes to which they address, however, they differ from the present invention.

A FIRST EXAMPLE, U.S. Pat. No. 3,743,346 to Senn et al. teaches a folding extension having all rigid walls for a camper or the like is provided in practice of this invention. A folding extension may be built onto each side of a camper body at the time it is built, or it may be provided as kit to be added to the side of an existing camper for providing a supplemental berth. A floor section and a roof are pivotally attached to the side wall of a camper to pivot down and up therefrom, respectively. The roof section folds down over the floor section when stowed to provide weather protection. Upon unfolding, a side wall and a pair of end walls slide outwardly from beneath the floor section and then pivot upwardly to form the walls of the extension. The roof section pivots back down over the side and end walls to hold them in place and close the assembly.

A SECOND EXAMPLE, U.S. Pat. No. 4,899,646 to Maras teaches a rain guard for use with a triple track storm window. The rain guard comprises a generally rectangular body made of a plastic material having top edge, bottom edge and a pair of vertical edges. The body has a top flange along its top edge, a pair of vertical flanges along its vertical edges and a dome section extending from the flanges to the bottom edge. The body is designed such that the vertical flanges will fit within one of the tracks of a triple track storm window.

A THIRD EXAMPLE, U.S. Pat. No. 5,088,540 to Harris teaches an apparatus arranged for mounting interiorly of a window between a lowermost window sash and a window sill that is provided with spaced triangular side walls and a telescoping forward housing receiving a shield plate therewithin. Both the shield plate and housing include a ceiling flange arranged at an obtuse included angle relative to the plate and housing surface respectively. Further, a filtration screen and a motorized fan assembly is positionable overlying an upper peripheral edge of the organization to enhance ventilation into an associated interior room.

A FOURTH EXAMPLE, U.S. Pat. No. 5,228,238 to Fenkell teaches a storm shutter for protecting glass windows and doors that employs one or more transparent unbreakable panels having edges effectively increased in thickness to be retained in respective tracks in the shutter frame, the track having openings narrower than the thickened panel edges. To accommodate different coefficients of thermal expansion for the panel and frame, the track cross-sectional area is considerably larger than the thickened panel edge, yet the narrowed track opening retains the thickened edges, even if the panel is bowed by applied forces. Edge thickening may be effected by securing strips of the panel material along the panel edges. The shutter frame is pivotably mounted on a casing, and a retainer is slidable on the casing to lock or release the frame for pivoting relative to the casing. If the panel is movable along its tracks, a motor has a drive shaft fixed to the casing and about which support strips are wound to pull on the panel. The panel is biased away from the drive shaft to move the panel when the support strips are slack. Pivot pins, each having a ring at one end journaled about the drive shaft, are secured in the frame tracks to permit the frame to be selectively pivoted. For protecting a fixed pane door or window, the shutter casing is secured directly to the window or door frame.

A FIFTH EXAMPLE, U.S. Pat. No. 6,341,811 B1 to Fenkell teaches a motor vehicle window weather shield that is comprised of a base and an awning. The awning slidably engages the base and is designed to extend from the base, over a window on a motor vehicle. The awning may be locked le into one of several positions relative to the base. The base is releasably secured to the hood of a motor vehicle via magnets.

It is apparent that numerous innovations for shades have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a shade for preventing rain from entering an open double hung window of any width that avoids the disadvantages of the prior art.

ANOTHER OBJECT of the present invention is to provide a shade for preventing rain from entering an open double hung window of any width that is simple to use.

BRIEFLY STATED, STILL ANOTHER OBJECT of the present invention is to provide a shade for preventing rain from entering an open double hung window of any width. A pair of side panels extend rearwardly from opposite ends of affront panel so as to form an assembly for attaching to the double hung window by an apparatus. Each side panel is right triangular-shaped. The front panel is length adjustable by being a pair of telescoping panels. The apparatus includes hook and loop fasteners, a magnetic tape, or a channel affixed to the double hung window receiving a depending lip of the front panel.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
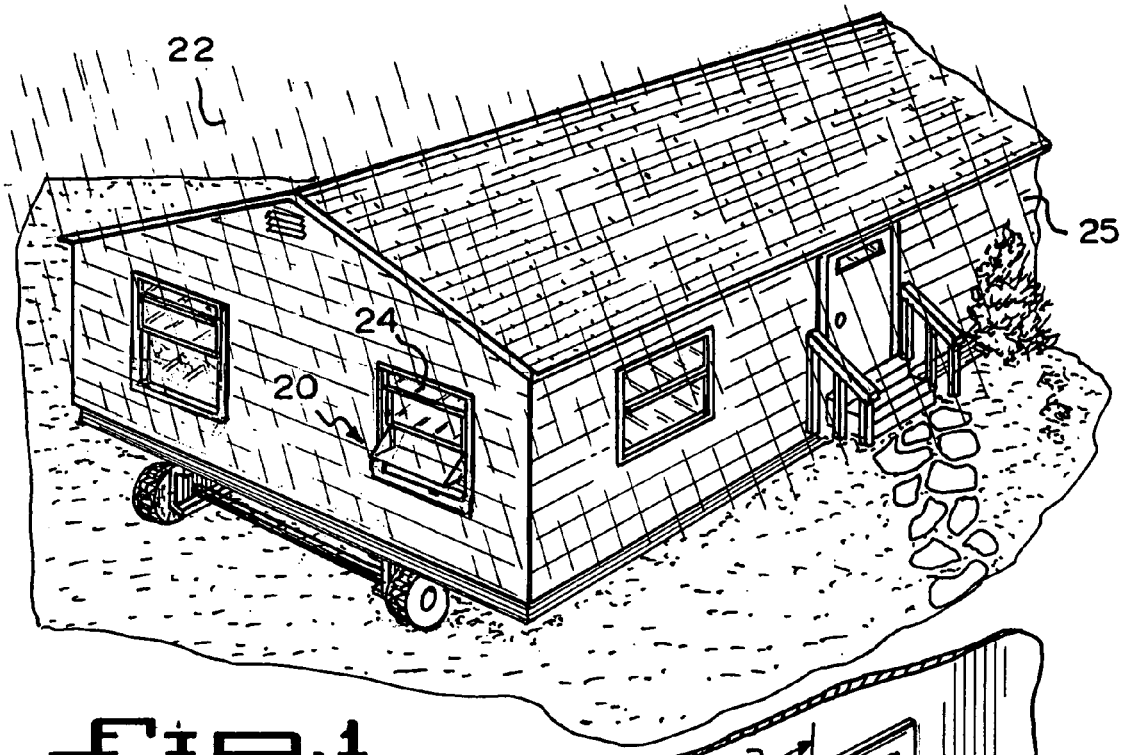
FIG. 1 is a diagrammatic perspective view of the present invention in use.

20 shade of present invention for preventing rain 22 from entering open double hung window 24 of any width
22 rain
24 double hung window
25 dwelling

FIRST EMBODIMENT

120 shade
126 front panel
128 pair of side panels
130 apparatus for attaching front panel 126 and pair of side panels 128 to double hung window 24
132 opposite ends of front panel 126
134 assembly for attaching to double hung window 24 by apparatus 130, and when assembly 134 is attached to double hung window 24, assembly 134 prevents rain 22 from entering open double hung window 24
136 hook and loop fasteners of apparatus 130
138 magnetic tape of apparatus 130 for use when double hung window 24 is metallic
140 one portion of hook and loop fasteners 136 of apparatus 130
142 mating portion of hook and loop fasteners 136 of apparatus 130 for disposing on double hung window 24
144 uppermost edge of front panel 126
146 pair of sidemost edges of front panel 126
148 hypotenuse of each side panel of pair of side panels 128
150 base of each side panel of pair of side panels 128
152 leg of each side panel of pair of side panels 128

SECOND EMBODIMENT

220 shade
226 front panel
228 pair of side panels
248 hypotenuse of one side panel 228
254 pair of telescoping panels of front panel 226
256 slot in one side panel 228
258 free edge of telescoping panel of pair of telescoping panels 254 of panel 226
260 break-off portions of free edge 258 of telescoping panel of pair of telescoping panels 254

THIRD EMBODIMENT

320 shade
326 front panel
328 side panel of pair of side panels
344 uppermost edge of telescoping panel of pair of telescoping panels 354 of front panel 326
354 pair of telescoping panels of front panel 326
358 free edge of telescoping panel of pair of telescoping panels 354 of front panel 326
362 shim strip

FOURTH EMBODIMENT

420 shade
426 front panel
430 apparatus
444 uppermost edge of front panel 426
464 depending lip of apparatus 430
466 channel of apparatus 430 for affixing to double hung window 24

DETAILED DESCRIPTION OF THE PREFERRED EMBODIMENT

Figure 3:
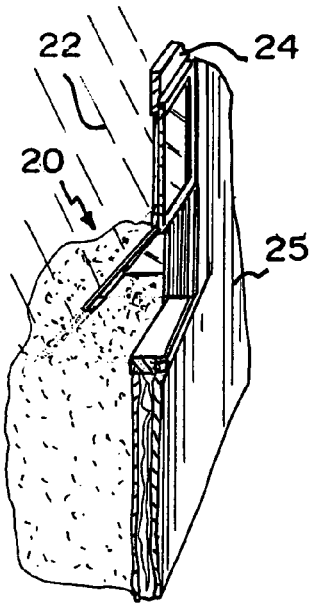
FIG. 3 is a diagrammatic cross sectional view taken along LINE 3—3 in FIG. 2.
Figure 2:
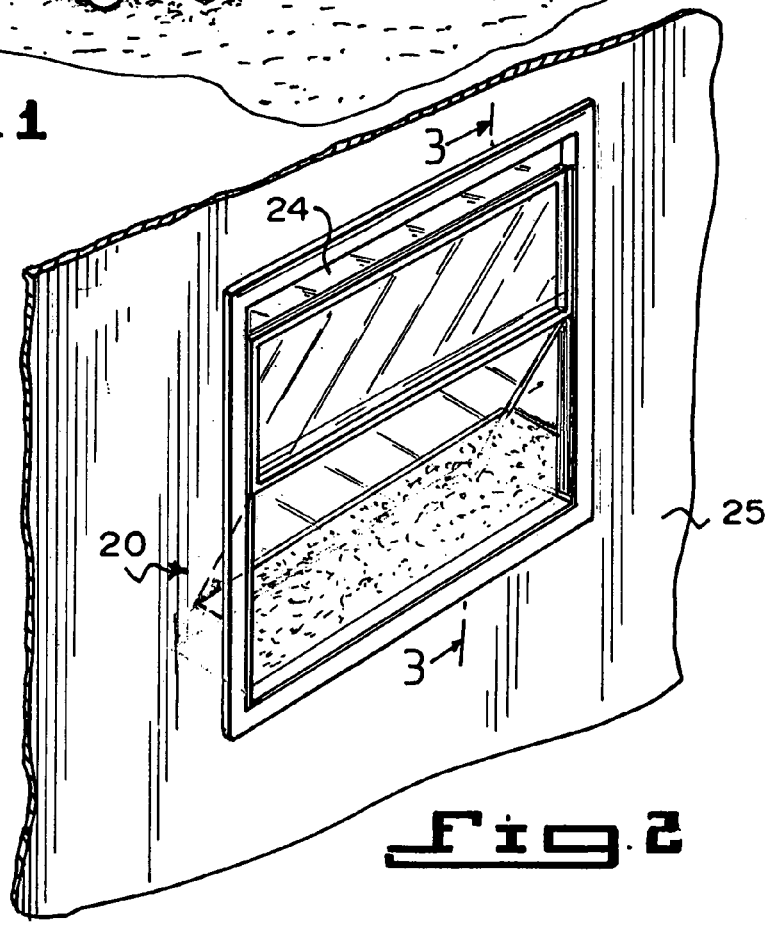
FIG. 2 is an enlarged diagrammatic perspective view of the area generally enclosed by the dotted curve identified by ARROW 2 in FIG. 1.

Referring now to the figures, in which like numerals indicate like parts, and particularly to FIGS. 1–3, the shade of the present invention is shown generally at 20 for preventing rain 22 from entering an open double hung window 24 of any width in a typical dwelling.

Figure 4:
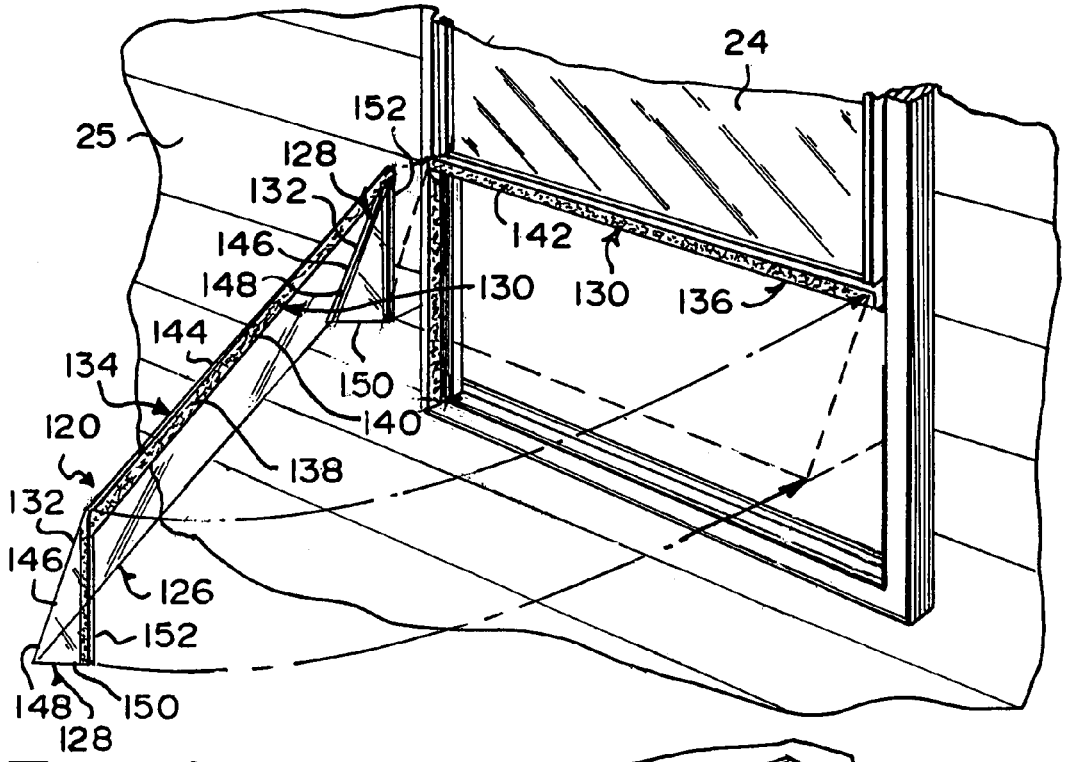
FIG. 4 is a diagrammatic perspective view of a first embodiment of the present invention not being width adjustable and in use.
Figure 5:
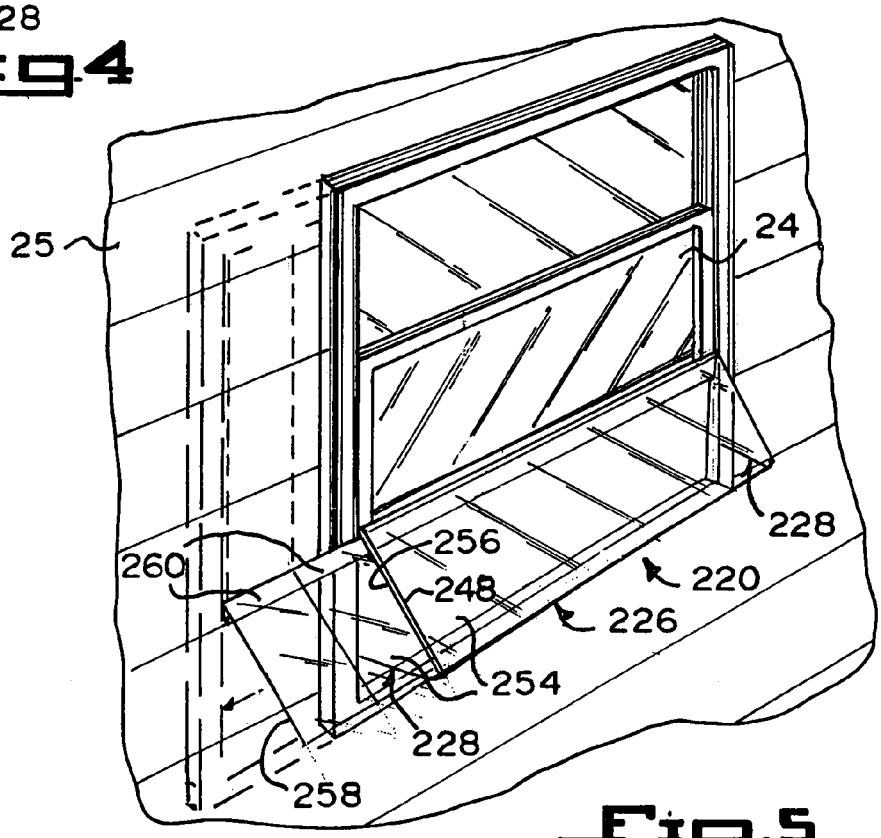
FIG. 5 is a diagrammatic perspective view of a second embodiment of the present invention being width adjustable and in use.
Figure 6:
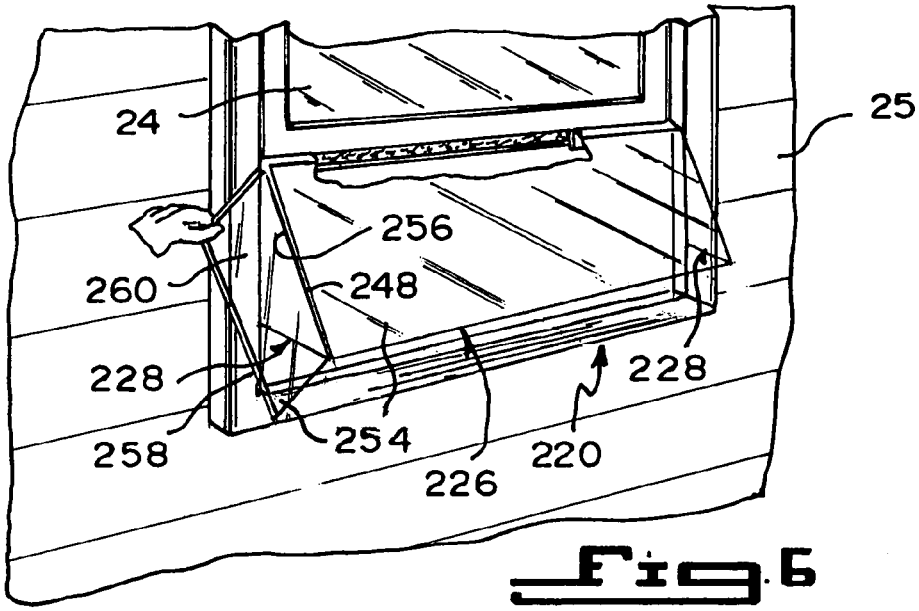
FIG. 6 is a diagrammatic perspective view of the second embodiment of the present invention having its width adjusted and in use.
Figure 7:
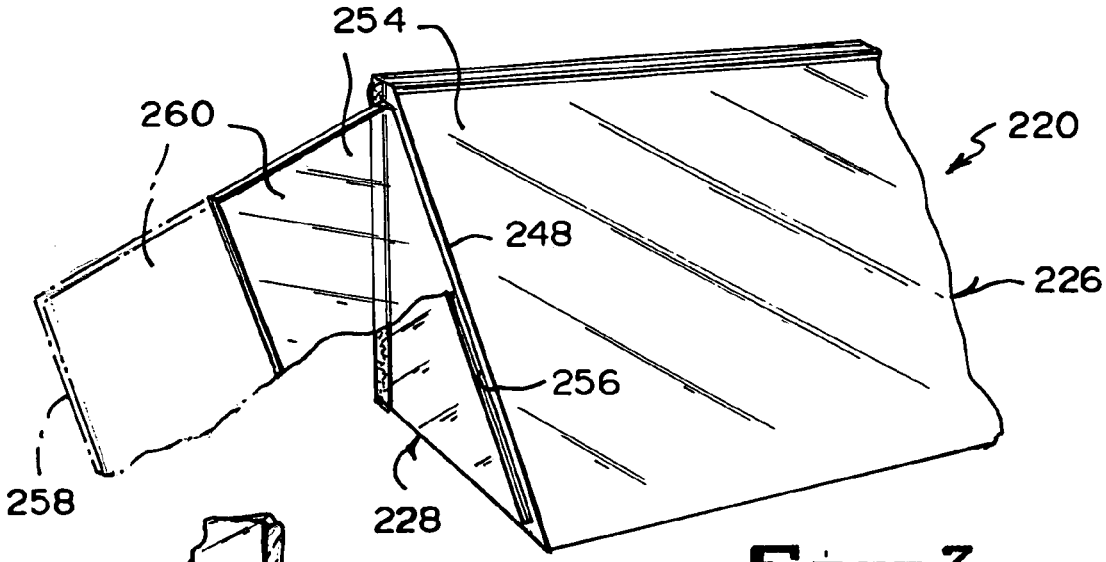
FIG. 7 is an enlarged diagrammatic perspective view of the area generally enclosed by the dotted curve identified by ARROW 7 in FIG. 6.
Figure 8:
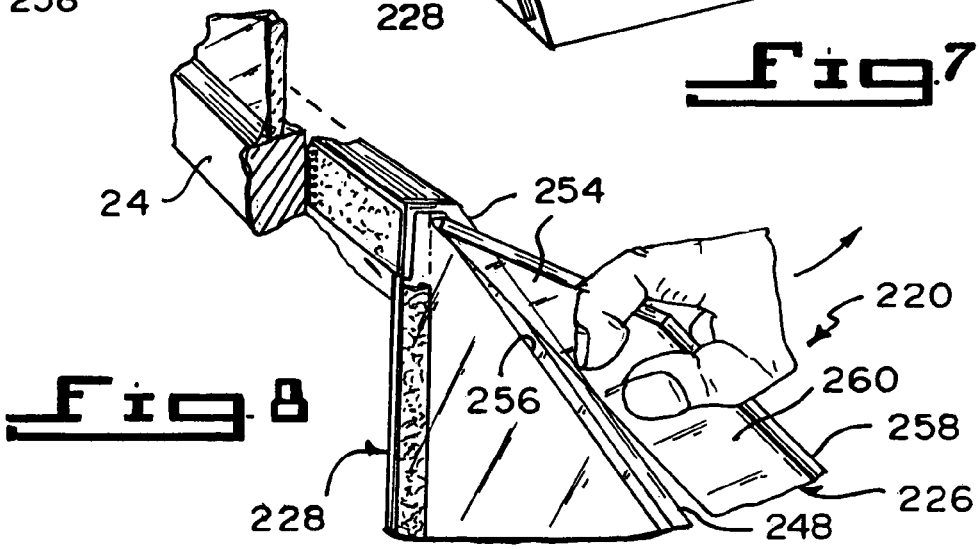
FIG. 8 is an enlarged diagrammatic perspective view taken generally in the direction of ARROW 8 in FIG. 6.

The configuration of a first embodiment of the shade 120 can best be seen in FIG. 4, and as such, will be discussed with reference thereto.

The shade 120 comprises a front panel 126, a pair of side panels 128, and apparatus 130 for attaching the front panel 126 and the pair of side panels 128 to the double hung window 24. The pair of side panels 128 extend rearwardly from opposite ends 132 of the front panel 126 so as to form an assembly 134. The assembly 134 is for attaching to the double hung window 24 by the apparatus 130, and when the assembly 134 is attached to the double hung window 24, the assembly 134 prevents the rain 22 from entering the open double hung window 24.

The apparatus 130 includes one of hook and loop fasteners 136 and a magnetic tape 138.

One portion 140 of the hook and loop fasteners 136 of the apparatus 130 is disposed around the assembly 134 and a mating portion 142 of the hook and loop fasteners 136 of the apparatus 130 is for disposing on the double hung window 24.

The magnetic tape 138 of the apparatus 130 is disposed around the assembly 134 and is for use when the double hung window 24 is metallic.

The assembly 134 is preferably transparent for seeing through when in place.

The front panel 126 is flat and rectangular-shaped, and has an uppermost edge 144 and a pair of sidemost edges 146.

Each side panel 128 is flat and right triangular-shaped, and has an hypotenuse 148, a base 150, and a leg 152.

The pair of side panels 128 extend rearwardly from the front panel 126, with the hypotenuses 148 of the pair of side panels 128 being coincident with the pair of sidemost edges 146 of the front panel 126.

The apparatus 130 is disposed along the legs 152 of the pair of side panels 128 and the uppermost edge 144 of the front panel 126.

The configuration of a second embodiment of the shade 220 can best be seen in FIGS. 5–8, and as such, will be discussed with reference thereto.

The shade 220 is similar to the shade 120, except that the front panel 226 is length adjustable.

The front panel 226 comprises a pair of telescoping panels 254. The pair of telescoping panels 254 of the front panel 226 extend inwardly from the pair of side panels 228, respectively, and overlap each other.

One side panel 228 has a slot 256. The slot 256 in the one side panel 228 extends slightly inwardly of, and is in alignment with, the hypotenuse 248 of the one side panel 228.

The telescoping panel 254 of the front panel 226 extending from the other side panel 228 has a free edge 258. The free edge 258 of the telescoping panel 254 of the front panel 226 extends through the slot 256 in the one side panel 228 and contains break-off portions 260 that are removed when a desired length of the front panel 226 is achieved.

Figure 9:
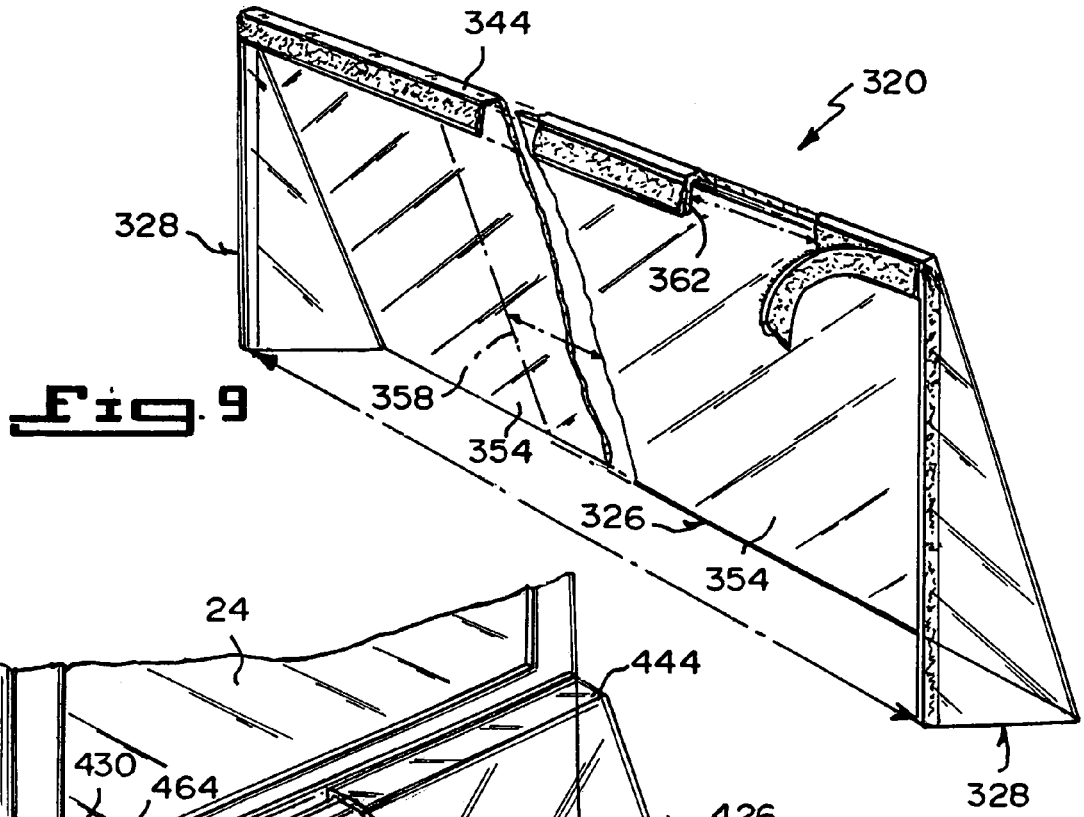
FIG. 9 is a diagrammatic perspective view of a third embodiment of the present invention being width adjustable.

The configuration of a third embodiment of the shade 320 can best be seen in FIG. 9, and as such, will be discussed with reference thereto.

The shade 320 is similar to the shade 220, except that the free edge 358 of the telescoping panel 354 of the front panel 326 stops short of the one side panel 328.

The shade 320 further comprises a shim strip 362. The shim strip 365 extends on the uppermost edge 344 of the telescoping panel 354 of the front panel 326 that is in front of the other telescoping panel 354 of the front panel 326 up to the free edge 358 of the other telescoping panel 354 of the front panel 326 so as to make up for the thickness of the other telescoping panel 354 of the front panel 326.

Figure 10:
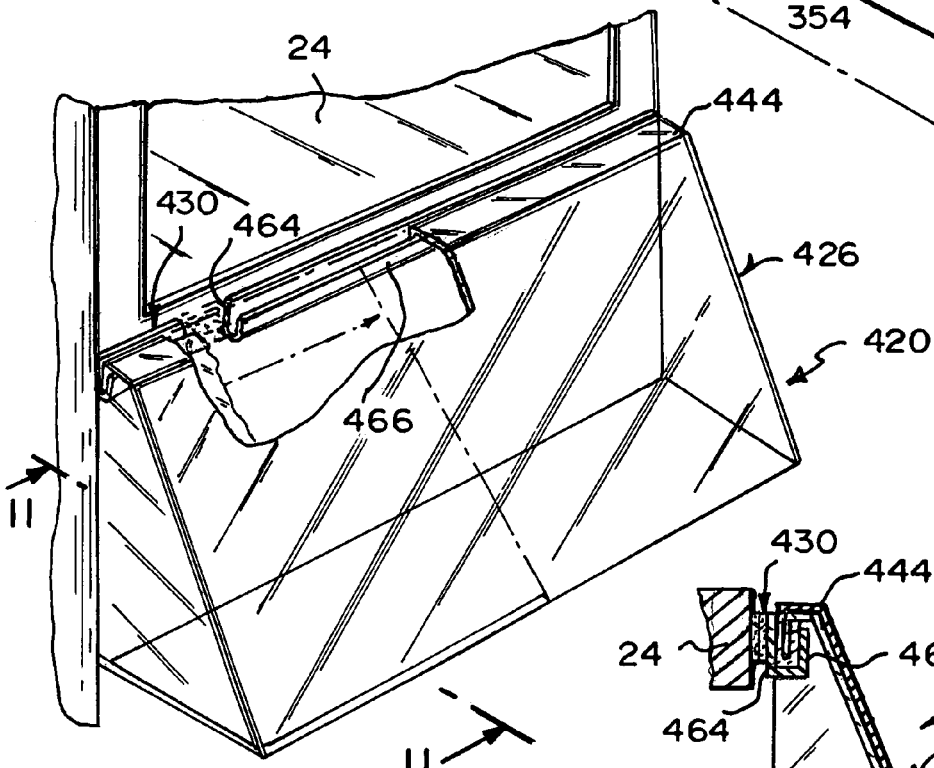
FIG. 10 is a diagrammatic perspective view of a fourth embodiment of the present invention being width adjustable and in use.
Figure 11:
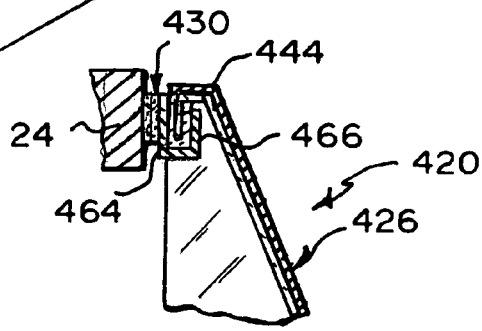
FIG. 11 is a diagrammatic cross sectional view taken along LINE 11—11 in FIG. 10.

The configuration of a fourth embodiment of the shade 420 can best be seen in FIGS. 10 and 11, and as such, will be discussed with reference thereto.

The shade 420 is similar to the shade 320, except that the apparatus 430 includes the uppermost edge 444 of the front panel 426 folded downwardly to form a depending lip 464, and a channel 466. The channel 466 of the apparatus 430 is for affixing to the double hung window 24 and le receives the depending lip 464 of the apparatus 430.

It will be understood that each of the elements described above, or two or more together, may also find a useful application in other types of constructions differing from the types described above.

While the invention has been illustrated and described as embodied in a shade for preventing rain from entering an open double hung window of any width, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A shade for preventing rain from entering an open double hung window of any width, comprising:

a) a front panel;

b) a pair of side panels; and c) means for attaching said front panel and said pair of side panels to the double hung window;

wherein said pair of side panels extend rearwardly from opposite ends of said front panel so as to form an assembly; and wherein said assembly is for attaching to the double hung window by said means, and when said assembly is attached to the double hung window, said assembly prevents said rain from entering the open double hung window, wherein said front panel has an uppermost edge; and wherein said front panel has a pair of sidemost edges, wherein each said side panel has an hypotenuse;

wherein each said side panel has a base; and wherein each said side panel has a leg, wherein said front panel comprises a pair of telescoping panels, wherein one side panel has a slot;

wherein said slot in said one side panel extends slightly inwardly of said hypotenuse of said one side panel; and wherein said slot in said one side panel is in alignment with said hypotenuse of said one side panel.

2. The shade as defined in claim 1, wherein said means includes hook and loop fasteners.

3. The shade as defined in claim 1, wherein said means includes a magnetic tape.

4. The shade as defined in claim 2, wherein one portion of said hook and loop fasteners of said means is disposed around said assembly; and wherein a mating portion of said hook and loop fasteners of said means is for disposing on the double hung window.

5. The shade as defined in claim 3, wherein said magnetic tape of said means is disposed around said assembly; and wherein said magnetic tape of said means is for use when the double hung window is metallic.

6. The shade as defined in claim 1, wherein said assembly is transparent for seeing through when in place.

7. The shade as defined in claim 1, wherein said front panel is flat; and wherein said front panel is rectangular-shaped.

8. The shade as defined in claim 1, wherein each said side panel is flat; and wherein each said side panel is right triangular-shaped.

9. The shade as defined in claim 1, wherein said pair of side panels extend rearwardly from said front panel; and wherein said hypotenuses of said pair of side panels are coincident with said pair of sidemost edges of said front panel, respectively.

10. The shade as defined in claim 1, wherein said means is disposed along said legs of said pair of side panels; and wherein said means is disposed along said uppermost edge of said front panel.

11. The shade as defined in claim 1, wherein said front panel is length adjustable.

12. The shade as defined in claim 1, wherein said pair of telescoping panels of said front panel extend inwardly from said pair of side panels, respectively; and wherein said pair of telescoping panels of said front panel overlap each other.

13. The shade as defined in claim 1, wherein said telescoping panel of said front panel extending from the other side panel has a free edge.

14. The shade as defined in claim 13, wherein said free edge of said telescoping panel of said front panel extends through said slot in said one side panel;

wherein said free edge of said telescoping panel of said front panel contains break-off portions; and wherein said break-off portions of said free edge of said telescoping panel of said front panel are removed when a desired length of said front panel is achieved.

15. The shade as defined in claim 13, wherein said free edge of said telescoping panel of said front panel stops short of said one side panel.

16. The shade as defined in claim 15; further comprising a shim strip;

wherein said shim strip extends on said uppermost edge of said telescoping panel of said front panel that is in front of the other telescoping panel of said front panel up to said free edge of said other telescoping panel of said front panel so as to make up for thickness of said other telescoping panel of said front panel.

17. The shade as defined in claim 1, wherein said apparatus includes said uppermost edge of said front panel folded downwardly to form a depending lip; and wherein said apparatus includes a channel.

18. The shade as defined in claim 17, wherein said channel of said apparatus is for affixing to the double hung window; and wherein said channel of said apparatus receives said depending lip of said apparatus.

* * * * *